US008548187B2

(12) United States Patent
Yu

(10) Patent No.: US 8,548,187 B2
(45) Date of Patent: Oct. 1, 2013

(54) MULTI-CHANNEL SOUND PRODUCING STRUCTURE FOR HEADPHONES

(75) Inventor: Hsiang-Chih Yu, New Taipei (TW)

(73) Assignees: Abatech Electronics Co., Ltd., New Taipei (TW); Hsiang-Chih Yu, New Taipei (TW)

( * ) Notice: Subject to any disclaimer, the term of this patent is extended or adjusted under 35 U.S.C. 154(b) by 189 days.

(21) Appl. No.: 13/111,936

(22) Filed: May 19, 2011

(65) Prior Publication Data

US 2012/0294471 A1 Nov. 22, 2012

(51) Int. Cl.
*H04R 1/00* (2006.01)

(52) U.S. Cl.
USPC ..... 381/374; 381/431; 381/190

(58) Field of Classification Search
USPC ..... 381/41, 87, 184, 309, 335, 361, 367, 381/370–379, 386, 401–402, 404, 411, 424; 181/144, 145, 148, 163, 147, 154, 167
See application file for complete search history.

(56) References Cited

U.S. PATENT DOCUMENTS

| | | | | |
|---|---|---|---|---|
| 3,731,124 | A * | 5/1973 | Bryant | 310/326 |
| 7,340,071 | B2 * | 3/2008 | Huang | 381/309 |
| 2005/0058311 | A1 * | 3/2005 | Branom | 381/309 |

* cited by examiner

*Primary Examiner* — Curtis Kuntz
*Assistant Examiner* — Joshua Kaufman
(74) *Attorney, Agent, or Firm* — Leong C. Lei

(57) ABSTRACT

A sound producing structure for headphones comprises an enclosure composed of a box and a perforated cover for sealing the box, the box defining a compartment for accommodating a low-frequency ceramic speaker therein, the low-frequency ceramic speaker being suspended between two opposing interior surfaces of the box respectively via a spring means, two ceramic speakers respectively mounted to a top interior surface and a bottom interior surface of the box respectively via a mounting means, the two ceramic speakers being slantingly mounted and facing toward the perforated cover. The low-frequency ceramic speaker and the two ceramic speakers can work together to deliver sounds of different frequency bands to produce a multi-channel sound effect. In addition, the sound producing structure can be employed to design a thinner headphone for increasing portability.

3 Claims, 6 Drawing Sheets

MULTI-CHANNEL SOUND PRODUCING STRUCTURE FOR HEADPHONES

TECHNICAL FIELD OF THE INVENTION

The present invention relates to a sound producing structure and, more particularly, to a sound producing structure for use in headphones, which can deliver sounds of different frequency bands so as to produce multi-channel sound effect.

DESCRIPTION OF THE PRIOR ART

Conventional headphones generally contain a speaker that is typically composed of a stationary' magnet and a diaphragm attached to a voice coil, and can only produce stereo sound. Furthermore, since the conventional headphones employ a speaker with a voice coil, it is difficult for them to be designed as a compact form for increasing portability Although the existing headphones used for computers have multi-channel sound effect, they are large in structure due to the voice coil contained in the speaker. To design thinner headphones, the voice coils of the existing headphones have to be replaced with smaller devices. To meet the requirements of high quality sound, a headphone should have a capability of reproducing the low frequencies, the middle frequencies, and the high frequencies of the original sound at the same time so as to create a multi-channel or surround sound effect.

In view of the foregoing, based on the long-term experiences of the headphones and after constant efforts on the development and innovation of the headphones, the applicant has contrived an improved structure for use in headphones, which can reproduce sound more perfectly and reduce the sizes of headphones.

SUMMARY OF THE INVENTION

The primary object of the present invention is to provide a sound producing structure for headphones that can deliver sounds of different frequency bands through a low-frequency ceramic speaker and two ceramic speakers so as to produce a multi-channel sound effect, and can reduce the sizes of headphones for increasing portability.

The aforementioned sound producing structure for headphones comprises an enclosure composed of a box and a perforated cover for sealing the box, the box defining a compartment for accommodating a low-frequency ceramic speaker therein, the low-frequency ceramic speaker being suspended between two opposing interior surfaces of the box respectively via a spring means, two ceramic speakers respectively mounted to a top interior surface and a bottom interior surface of the box respectively via a mounting means, the two ceramic speakers being slantingly mounted and facing toward the perforated cover. The low-frequency ceramic speaker and the two ceramic speakers can work together to deliver sounds of different frequency bands to produce a multi-channel sound effect.

In the aforementioned sound producing structure for headphones, the mounting means may include a rod and a slant plate, the rod extending downward from a top interior surface of the box or extending upward from a bottom interior surface of the box, and terminating at the slant plate capable of fastening a respective ceramic speaker, which is slantingly mounted and faces toward the perforated cover. Furthermore, the rod is formed with a ball, and the slant plate is formed with a socket rotatably fitted around the ball of the rod so that the slant plate can be adjusted at a predetermined angle according to the size of a respective ceramic speaker.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
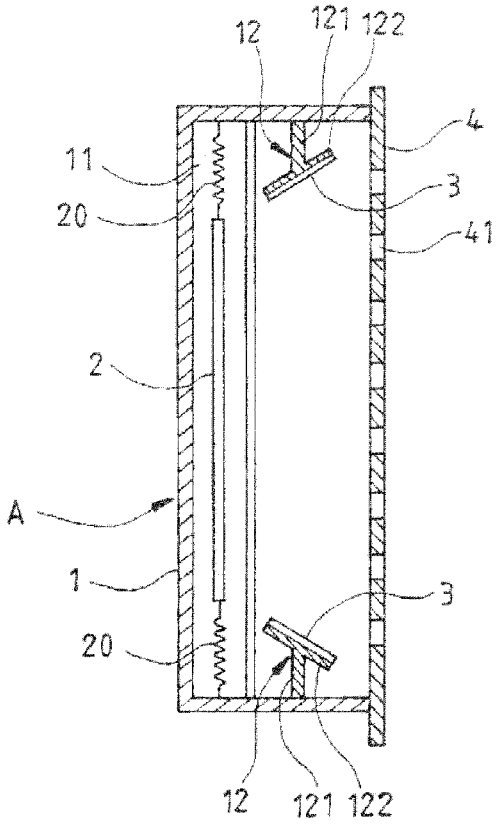
FIG. 1 is a sectional view of an embodiment of the present invention.
Figure 2:
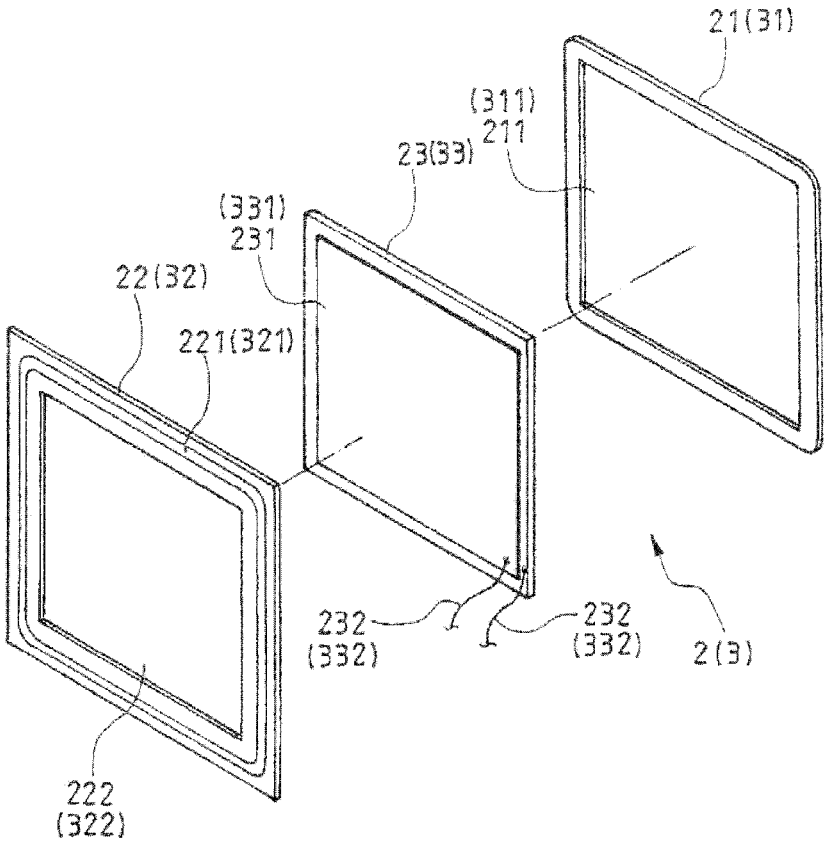
FIG. 2 is an exploded view of a ceramic speaker of the present invention.

FIGS. 1 and 2 respectively show a sectional view of a multi-channel sound producing structure and an exploded view of a ceramic speaker according to the present invention. As shown in FIG. 1, the sound producing structure comprises an enclosure composed of a box 1 and a front cover 4 for sealing the box 1. In the box 1, a low-frequency ceramic speaker 2 and two ceramic speakers 3 are located, each ceramic speaker having a low profile (or thin depth) and being operated at a different frequency band. The box 1 defines a compartment 11 therein, in which the low-frequency ceramic speaker 2 is provided. The low-frequency ceramic speaker 2 is suspended between two opposing interior surfaces of the box 1 respectively via a spring means 20 connected between a periphery of the speaker 2 and a respective interior surface of the box 1. The spring means 20 can be a coil spring, leaf spring, spring wire or the like. A mounting means 12 is used for mounting a ceramic speaker 2 to the box 1. In this embodiment, the mounting means 12 includes a rod 121 and a slant plate 122. As shown, two rods 12 respectively extend downward from a top interior surface of the box 1 and upward from a bottom interior surface of the box 1, Both rods 12 respectively terminate at a respective slant plate 122. The two ceramic speakers 3 are slantingly mounted and face toward the front cover 4.

As shown in FIG. 2, the low-frequency ceramic speaker 2 and the two ceramic speakers 3 generally include an upper cone paper 21 or 31, a lower cone paper 22 or 32, and a steel sheet 23 or 33. The lower cone paper 22 or 32 defines an opening 222 or 322, which is surrounded by a stepped edge 221 or 321. The upper cone paper 21 or 31 has a dimension substantially the same as the inner surface of the stepped edge 221 or 321 and defines an opening 211 or 311. The steel sheet 23 or 33 contains a main portion 231 or 331 of the ceramic speaker, which is made of multiple overlaid ceramic sheets, and soldered with wires 232 or 332 for electrically connected to a post amplifying circuit of a product.

As shown in FIG. 1, the front cover 4 is a perforated panel, which contains a plurality of through holes 41. The aforementioned components are combined to form a sound producing structure or module (A). The low-frequency ceramic speaker 2 and the two ceramic speakers 3 can work together to deliver sounds of different frequency bands to produce a multi-channel or surround sound effect. Due to each speaker having no voice coil contained therein, the depth or thickness of the sound producing structure can be significantly reduced, and this can facilitate a thinner design of headphones for increasing portability.

Figure 3:
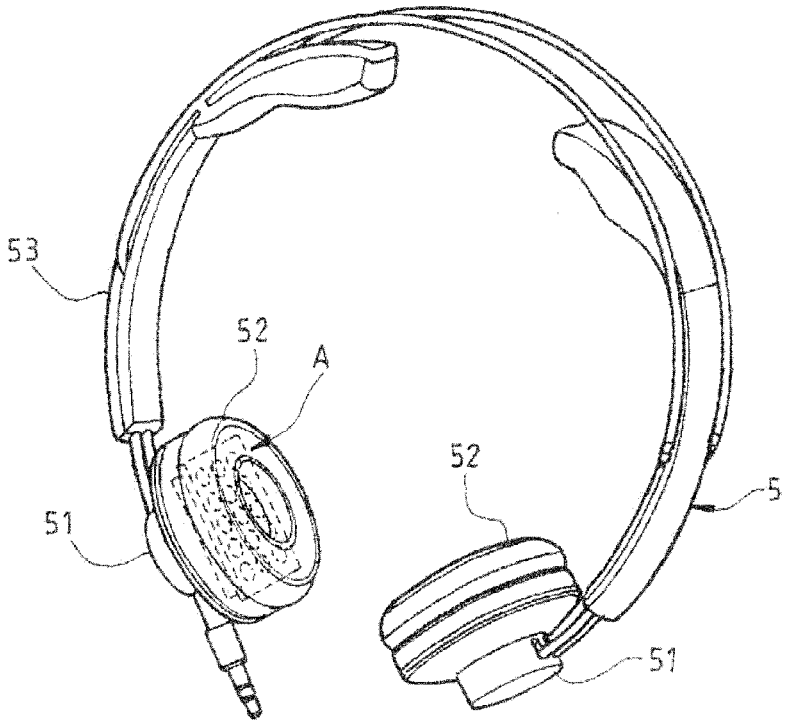
FIG. 3 is an exemplary application of the present invention.
Figure 4:
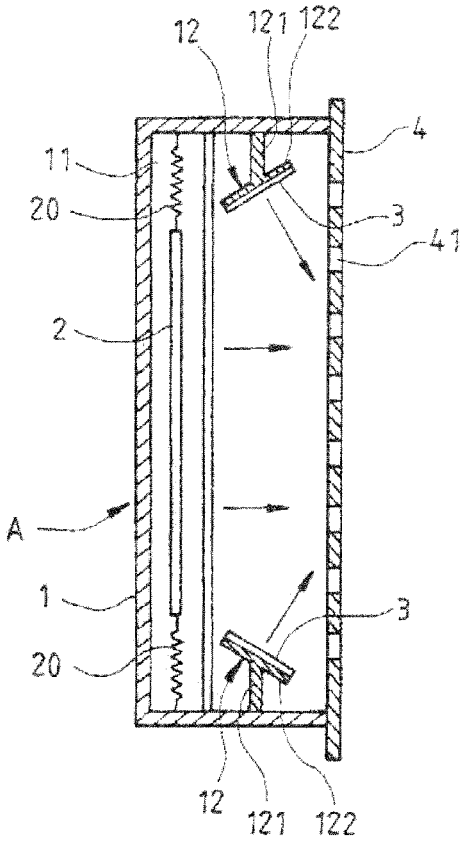
FIG. 4 shows an operating condition of the embodiment of the present invention.

FIGS. 3 and 4 respectively show an exemplary application and an operating condition of the present invention. As shown, two pieces of the sound producing structures (A) are respectively mounted in two housings 51, each of which is attached with an ear pad 52. A headband 53 is connected between the two housing 51 to form a headphone 5 that can fit across a user's head to allow the ear pads 52 to be held over the ears. All the aforementioned speakers within either of the housings 51 can work together to produce sounds of different frequency bands to enable the headphone 5 to produce a multi-channel or surround sound effect.

Figure 5:
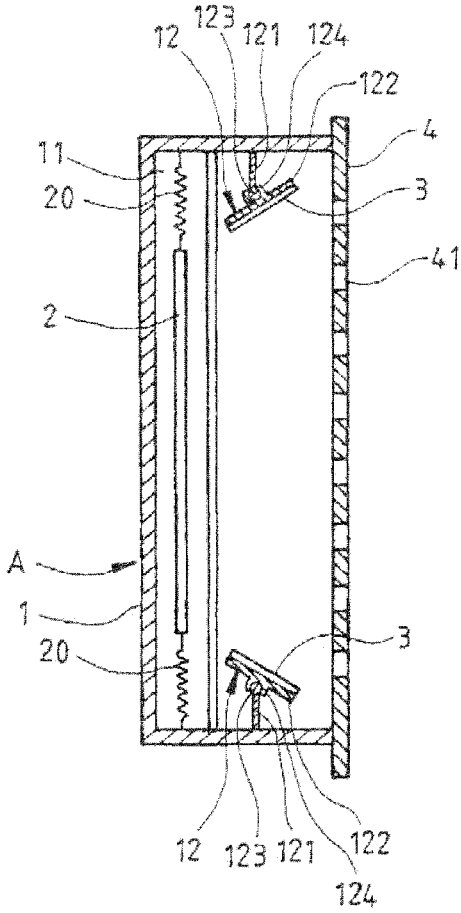
FIG. 5 is a sectional view of another embodiment of the present invention.
Figure 6:
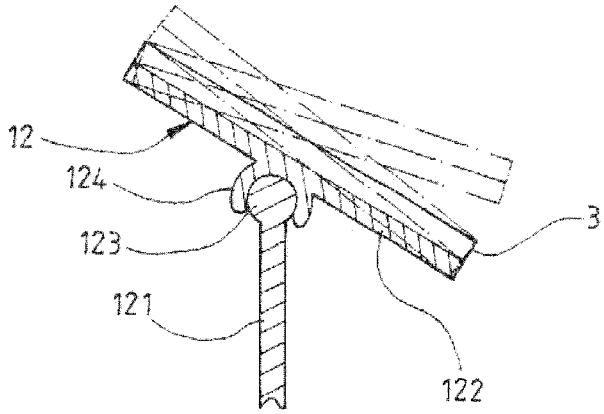
FIG. 6 is a sectional view showing an adjustable mounting means of the present invention.

FIGS. 5 and 6 respectively show another embodiment and an adjustable mounting means for the ceramic speakers according to the present invention, As shown, each mounting means 12 includes a rod 121 and a slant plate 122, wherein the rod 121 extends downward from a top interior surface of the box 1 or extends upward from a bottom interior surface of the box 1, and terminates at the slant plate 122 capable of fastening a respective ceramic speaker 3, the rod is formed with a ball 123, and the slant plate 122 is formed with a socket 124 rotatably fitted around the ball 123 of the rod 121 so that the slant plate 122 can be adjusted at a predetermined angle according to the size of a respective ceramic speaker 3. Generally, either of the two ceramic speakers is slantingly mounted and faces towards the box 1. The user can adjust the angle of the slant plate 122 to accommodate a ceramic speaker 3 within the box 1 according to the size. In addition, the size of the ceramic speaker 3 can be changed together with an adjustment of the angle of the slant plate 122 to cause the speaker to have different vibrating amplitude.

In view of the foregoing, the present invention employs a low-frequency ceramic speaker and two ceramic speakers in an enclosure composed of a box and a perforated cover to form a sound producing structure whereby the speakers can work together to deliver sounds of different frequency bands to produce a multi-channel or surround sound effect. The sound producing structure can be employed to design a thinner headphone for increasing portability. It is believed that the present invention is a novel and useful design.

Although the present invention has been described with a certain degree of particularity, it is understood that the present disclosure is made by way of example only and the combination and arrangement of parts may be resorted to without departing from the spirit and scope of the invention hereinafter claimed.

I claim:

1. A sound producing structure for headphones, comprising an enclosure composed of a box and a perforated cover for sealing said box, said box defining a compartment for accommodating a low-frequency ceramic speaker therein, said low-frequency ceramic speaker being suspended between two opposing interior surfaces of said box respectively via a spring means, two ceramic speakers respectively mounted to a top interior surface and a bottom interior surface of said box respectively via a mounting means, the two ceramic speakers being slantingly mounted and facing toward said perforated cover; whereby said low-frequency ceramic speaker and the two ceramic speakers can work together to deliver sounds of different frequency bands to produce a multi-channel sound effect; and further, due to each speaker having no voice coil contained therein, the sound producing structure can be employed to design a thinner headphone for increasing portability; wherein said mounting means includes a rod and a slant plate, said rod extending downward from a top interior surface of said box or extending upward from a bottom interior surface of said box, and terminating at said slant plate capable of fastening a respective ceramic speaker, which is slantingly mounted and faces toward said perforated cover, and further wherein said rod is formed with a ball, said slant plate is formed with a socket rotatably fitted around said ball of said rod so that said slant plate can be adjusted at a predetermined angle according to the size of a respective ceramic speaker.

2. The sound producing structure for headphones as claimed in claim 1, wherein said spring means is a coil spring, leaf spring, or spring wire.

3. The sound producing structure for headphones as claimed in claim 1, wherein said mounting means includes a rod and a slant plate, said rod extending downward from a top interior surface of said box or extending upward from a bottom interior surface of said box, and terminating at said slant plate capable of fastening a respective ceramic speaker, which is slantingly mounted and faces toward said perforated cover.

* * * * *